US005331834A

United States Patent [19]

Yoshida

[11] Patent Number: 5,331,834

[45] Date of Patent: Jul. 26, 1994

[54] ROLLING METHOD AND APPARATUS USING PLANETARY CROSS-ROLLS

[76] Inventor: Keiichiro Yoshida, 497, Shimonagayoshi, Mobara, Chiba, Japan

[21] Appl. No.: 985,212

[22] Filed: Dec. 3, 1992

[30] Foreign Application Priority Data

Mar. 16, 1992 [JP] Japan ..... 4-090238
Mar. 18, 1992 [JP] Japan ..... 4-091970

[51] Int. Cl.[5] ..... B21B 1/42; B21B 13/20

[52] U.S. Cl. ..... 72/191; 72/220; 72/366.2

[58] Field of Search ..... 72/190, 191, 192, 194, 72/195, 215, 220, 365.2, 366.2

[56] References Cited

U.S. PATENT DOCUMENTS 3,348,401 10/1967 Sporck ..... 72/194
4,300,377 11/1981 Hirata ..... 72/205
5,035,131 7/1991 Fink et al. ..... 72/190

FOREIGN PATENT DOCUMENTS 0166336 9/1984 Japan ..... 72/220
59-46683 11/1984 Japan .
0006234 1/1985 Japan ..... 72/220
0254302 11/1991 Japan ..... 72/220

*Primary Examiner*—Lowell A. Larson
*Assistant Examiner*—Thomas C. Schoeffler
*Attorney, Agent, or Firm*—Wenderoth, Lind & Ponack

[57] ABSTRACT

A rolling method and apparatus permits a long metal blank to be rolled across the width thereof at a high rolling speed. According to one specific embodiment of, the method and apparatus, a sun roller is mounted to a machine stand, and a set of planetary rollers is mounted for rolling movement around the sun roller. The long metal blank is rolled between the sun roller and the set of planetary rollers by feeding it in the direction of the center line axes through the sun roller and the set of planetary rollers. The method and apparatus provide a planetary cross-rolling process that may proceed in a successive manner. According to another specific embodiment of the method and apparatus, a sun roller is rotatably mounted to a machine stand, and a set of planetary rollers is mounted for engaging and rolling around the sun roller. A back-up housing is mounted to the machine stand and is also mounted around the set of planetary rollers. A long metal blank is rolled between the set of planetary rollers and the back-up housing by feeding it in the direction of the center line axes through the set of planetary rollers. Both of the above embodiments feature the planetary cross-rolling process.

11 Claims, 8 Drawing Sheets

ROLLING METHOD AND APPARATUS USING PLANETARY CROSS-ROLLS

BACKGROUND OF THE INVENTION

1. Field of the Invention

The present invention relates generally to the roll working field, and more particularly to providing a high-speed rolling method that consists of causing a plurality of planetary cross-rolls to rolls a long metal blank across the width thereof, i.e., perpendicularly to the direction in which the metal blank is being fed through the rolls. The present invention relates also to providing a high-speed rolling apparatus that includes a plurality of planetary rolls that are driven to roll a long metal blank across the width thereof, i.e., perpendicularly to the direction in which the metal blank is being fed through the rolls.

2. Description of the Prior Art

One similar prior art method and apparatus employs the process of rolling a long metal blank by moving the rolls across the width of the metal blank as it is being fed through the rolls. This is disclosed by the same inventor as the current applicant in the Japanese patent publication No. 59-46683.

Another similar prior art method and apparatus employs a different rolling process that uses a pair of planetary rolls or a combination of a planetary roller and an anvil in order to roll a long metal blank as it is being fed through the rolls. This process is different from the first mentioned process in that the metal blank is rolled so that it can be elongated in its longitudinal direction.

The prior art method or apparatus, wherein the long metal blank may be rolled across its width while being fed through the rolls, has been used in the roll working industry with great success, but it is difficult to provide the high-speed rolling process because the rolls must undergo a reciprocating motion across the width of the metal blank being rolled while being fed forward. Mass production cannot be achieved with high efficiency. It is also observed that when the rolls are reciprocated across the width of the metal blank, the metal blank may be placed under an alternating rolling stress, and the metal blank may be elongated irregularly across the width. Thus the finished product may contain defects, such as irregularities (wavy formations) along the longitudinal edges on the opposite sides. Furthermore, the metal blank may have a greater rolling pressure on the center than along the longitudinal edges on the opposite sides, and may undergo a greater elongation on each of the opposite edges than in the center as the reduction becomes the greater. The finished product that results from the rolling process may contain wavy formations or cracks along each of the opposite edges, which will degrade the quality of the finished product. As another disadvantage of the rolling process, the metal blank will become hardened in the central area during the rolling process, and the central area will have a greater resistance to deformation than on each of the opposite edges.

In the second prior art method or apparatus, the rolling process uses a set of planetary rollers that is specifically provided for rolling a long metal blank in the direction of the length thereof (that is, in the direction in which the metal blank is being fed forward), and cannot be used for rolling the metal blank across the width thereof. This process has the disadvantage that it cannot provide a great rolling pressure because the backing-up pressures are not sufficient. In the rolling process that uses the set of planetary rollers and an anvil for rolling a long metal blank therebetween in the direction in which it is being fed forward, the set of planetary rollers and the anvil are arranged to permit the metal blank to be placed therebetween. This arrangement has the problem that the set of planetary rollers cannot be mounted rigidly, and the metal blank cannot be rolled across the width thereof. The rolling across the width may be performed by placing a short metal blank between the set of planetary rollers and the anvil at a certain angle with regard to the direction in which it is being fed. In this case, however, the problem is that the set of planetary rollers cannot provide sufficient backing-up pressure. For practical purposes, this rolling process cannot be used to roll a long metal blank across the width thereof.

SUMMARY OF THE INVENTION

In order to solve the problems of the prior art rolling processes, one object of the present invention is to provide a combination of a single sun roller and a set of planetary rollers wherein a long metal blank may be rolled across the width thereof as it is being fed stepwise between the sun roller and the set of planetary rollers.

Another object of the present invention is to provide a single sun roller, a set of planetary rollers, and a back-up housing that are arranged such that the set of planetary rollers is mounted for rolling around the sun roller, and the back-up housing is mounted around the set of planetary rollers, whereby a long metal blank can be rolled across the width thereof at high speeds between the set of planetary rollers and the back-up housing.

The first method of the present invention features a planetary cross-rolling process that can roll a long metal blank across the width thereof, by feeding it stepwise between the sun roller and the set of planetary rollers, specifically by feeding the long metal blank in the direction parallel with the center line axes through the sun roller and the set of planetary rollers. During the process, the metal blank may be rolled step by step while it is fed under tensile stress. The metal blank may be advanced by a predetermined length thereof immediately after one planetary roller finishes rolling. And the metal blank may be advanced by the predetermined length thereof at every interval between the two adjacent rollers (at every interval from the time at which one roller finishes rolling to the time at which the adjacent roller that follows begins rolling).

The first apparatus of the present invention includes a machine stand, a sun roller rigidly mounted to the stand, an anvil mounted to any appropriate part of the outer wall of the sun roller, a set of planetary rollers mounted around the sun roller so that the individual planetary rollers can engage with the sun roller and can roll around the sun roller, a back-up wheel mounted around the set of planetary rollers, and feeding means for feeding a long metal blank being rolled in the direction parallel with the center axial lines through the set of planetary rollers. The apparatus provides planetary cross-rolling capabilities. The sun roller has a groove formed on its outer wall which extends longitudinally in parallel with the center axis through the sun roller. This groove is adapted to accept the anvil that moves into and out of the groove. A wedge-like member is provided between the inner bottom of the groove and the inner wall of the anvil for controlling the movement of the anvil into and out of the groove. A pair of pinch rollers is provided on the entry side of the rolling arrangement, and a pair of pinch rollers is provided on the exit side of the rolling arrangement. Those pairs of pinch rollers work together so that a long metal blank can be fed stepwise into the rolling arrangement.

In the first apparatus described above, the anvil may be mounted either on the upper side wall or lower side wall of the sun roller. In its variation, two anvils may be provided, one being mounted on the upper side wall and the other being mounted on the lower side wall of the sun roller. In either case, each individual planetary roller of the set of planetary rollers may be arranged in an equally-spaced relationship inside the back-up wheel (housing). Also the set of planetary rollers may include a predetermined number of sets, each set including a plurality of planetary rollers, and each set may also be arranged in an equally-spaced relationship.

Several units of the apparatus as described above may be arranged in a tandem configuration in which those units are in series.

The rolling arrangement described above has two possible alternatives. One is the arrangement in which the upper face of the anvil is maintained in parallel with the surface of each individual planetary roller, and the other is the arrangement in which the former is maintained at a certain angle with regard to the latter. In the first alternative arrangement, a long metal blank must be fed through every step by the length equal to the entire length of the planetary roller, so the total amount of the metal blank that can be rolled simultaneously can be increased. Thus, a high rolling speed can be achieved, and any elongation along the length of the metal blank can be eliminated. In the second alternative arrangement, a long metal blank may be fed through every step by a certain length (which may be equal to several tenths of the entire length of the planetary roller), and may have the same area thereof rolled several times. Those two alternatives have tradeoff relationships, and each has merits and demerits. It is difficult to determine which is the better of the two, but the choice between the two alternatives may be made, depending upon the type of the material of a long metal blank to be rolled, the number of the individual rolling arrangements to be included in the tandem configuration, the amount of reductions that may occur when the particular metal blank passes through each individual rolling arrangement, and other factors.

The number of planetary rollers in each individual rolling arrangement should preferably be three rollers. If more than three planetary rollers are used, the width of the long metal blank being rolled must be restricted. Therefore, the number of planetary rollers may be chosen by considering the required width of the metal blank to be rolled. If less than three planetary rollers, or two planetary rollers, are used, they cannot be mounted with stability. If the interval between the adjacent planetary rollers is smaller than the width of the metal blank being rolled, at least one of the planetary rollers always engages with the metal blank. This makes it difficult to feed the metal blank through the rolling arrangement. It may be understood from the above that the number of planetary rollers is restricted by the particular width of the long metal blank being rolled.

The second method of the present invention is also directed toward rolling a long metal blank across the width thereof, wherein the metal blank is rolled between a set of planetary rollers and the back-up housing. According to the second method, the metal blank may be fed forward in parallel with the center axes through the set of planetary rollers. In this method, the metal blank may be advanced by a predetermined length thereof at every interval between the two adjacent rollers in the same manner as in the first method. This method also features the planetary cross-rolling process.

The second apparatus of the present invention includes a machine stand, a sun roller rotatably mounted to the stand, a set of planetary rollers, each adapted to engage the sun roller and to rotate about its own axis and orbit around the sun roller, a back-up housing mounted around the set of planetary rollers and rigidly mounted to the stand, an anvil mounted inside the back-up housing and acting together with each individual planetary roller in the set, and feeding means for feeding a long metal blank being rolled between the set of planetary rollers and the anvil. This apparatus features the planetary cross-rolling arrangement. The anvil may be mounted on the upper or lower side within the back-up housing, or two anvils may be mounted on both. Several units of the rolling arrangement or apparatus as described above may be arranged in into the tandem configuration in which those units are in series. The set of planetary rollers may include three or more planetary rollers arranged in an equally-spaced relationship inside the back-up housing. Also the set of a plurality of planetary rollers may be modified to include a predetermined number of sets, each set including a plurality of planetary rollers and the sets being mounted inside and around the back-up housing in the equally-spaced relationship.

In the preferred embodiment of the invention, as described above, the number of anvils that may be mounted inside the back-up housing may be one or two, and a single anvil may be located either on the upper or lower side within the back-up housing, or two anvils may be located on both. The rolling arrangement described above has two possible alternatives. One is an arrangement in which the face of the anvil is maintained in parallel with the surface of each individual planetary roller, and the other is an arrangement in which the former is maintained at a certain angle with regard to the latter. For the latter case, the anvil is tapered, which portion engages each individual planetary roller. When they engage each other in parallel, a long metal blank being rolled may be advanced by a length equal to the length of the planetary roller at every interval between the two adjacent rollers. When they engage each other at an angle, a long metal blank being rolled may be advanced by a length smaller than the length of the planetary roller through every step, which may be about 3 mm, for example. It may be appreciated that the rolling speed is greater when the anvil engages each planetary roller in parallel than when the anvil engages each planetary roller at an angle. In the former case, there is no elongation of the metal blank in its longitudinal direction, while in the latter case, there is some elongation.

In case the set of a plurality of planetary rollers includes a predetermined number of sets, and each set includes a plurality of planetary rollers, two or three rollers may be combined to compose each set, and several sets such as three sets may be provided to compose the a plurality of planetary rollers as shown in FIG. 8 or FIG. 12.

According to the first method and apparatus of the present invention, a long metal blank may be fed between the sun roller and the set of planetary rollers which is supported by the back-up wheel (housing), and may be advanced through every step of the rolling process. Thus, the rolling steps can proceed with every part of the hardware retaining its mechanical strength and rigidity.

As each set of the planetary rollers includes three or more planetary rollers, it ensures that the rolling process can take place in a highly stable manner. The interval between the two adjacent rollers (the interval from the time at which one roller finishes rolling to the time at which the adjacent roller that follows begins rolling) may be determined according to the specific number of rollers, the specific width of the long metal blank being rolled, and so on.

According to the second method and apparatus of the present invention, a long metal blank may be fed between the set of planetary rollers mounted rollingly around the sun roller and the back-up housing mounted around the set of planetary rollers, and may be advanced through every step of the rolling process. When the sun roller is rotated, it causes each individual planetary roller both to orbit around the sun roller and to rotate on its respective axis. In this way, the metal blank may be fed between the set of planetary rollers and the back-up housing, and may be advanced in parallel with the longitudinal axis through the set of planetary rollers. The second method and apparatus permits the metal blank to be rolled across the width thereof at a high rolling speed. The interval between the adjacent planetary rollers in the set can be greater when the metal blank is to be rolled by the outer circumference formed by the set of planetary rollers orbiting around the sun roller as in this embodiment, than when it is to be rolled by the inner circumference of the set of planetary rollers, that is, when the rolling occurs between the sun roller and the set of planetary rollers. Thus, in the second method and apparatus, the width of a rolled long metal blank product can be increased, and the sun roller can be rotated at a higher speed. According to this embodiment, the size of the apparatus can be reduced by considering the width of a rolled long metal blank product and then determining the interval between the individual planetary rollers accordingly. The apparatus can be operated with all functional parts retaining their respective mechanical strength or rigidity.

According to the present invention, a long metal blank may be fed into the apparatus and may be advanced under tensile stress. This forward movement of the metal blank may be aided by the pairs of pinch rollers on the entry and exit sides of the apparatus. Thus the metal blank may be advanced by a predetermined length thereof immediately after one planetary roller finishes rolling. And the metal blank may be advanced by the predetermined length thereof at every interval between the two adjacent rollers (at every interval from the time at which one roller finishes rolling to the time at which the adjacent roller that follows begins rolling).

The spacing between the surface of the anvil and the outer wall formed by the set of the planetary rollers may be adjusted by using a wedge-like member and moving it by means of a screw as known in the prior art.

The apparatus according to the present invention may include a single unit of the rolling arrangement or several units of the rolling arrangement connected in series in tandem. The number of rolling arrangements in the tandem configuration, the number of sets of planetary rollers or number of planetary rollers in each set in each rolling arrangement, etc. may be determined by the particular type of material of the long metal blank being rolled, the desired width of the metal blank, and other factors. Objects that may be processed according to the present invention include long metal blanks of round, angular, square, rectangular, or any other cross section, which can be rolled into a strip shape.

Using the method and apparatus of the invention, a long metal blank can be rolled across the width thereof, and the elongation in the direction of the width can be obtained through a single rolling arrangement, without producing any cracks or waves along the longitudinal edges of the rolled product. Every lot of long metal blanks can be rolled one after another on a continuous production basis and with high speed, and high productivity can be achieved.

Each one of the long metal blank lots can also be rolled across the width thereof successively through the rolling arrangements, and no elongation will occur along the length of the metal blank. Thus, a high rolling speed can be achieved.

If the prior art rolling process is applied to the long metal blank product which has been rolled by the present method and apparatus, in this case, the direction in which the long metal blank product has been rolled can be crossed. The product that has gone through the rolling processes of the present invention and the prior art has bidirectional properties nearly equal to the isotropy, so that it can be pressed or bent without any further working to select the products which have excellent mechanical properties.

As long metal blank can always be rolled in the one direction across the width, it can have constant directional properties in the metal fiber structure which reduces the magnetic resistance. Thus, the product may be used as an electromagnetic material which produces little heat.

BRIEF DESCRIPTION OF THE DRAWINGS

Those and other objects, features, and advantages of the present invention will become apparent from the following detailed description of several preferred embodiments that are shown in the accompanying drawings, in which:

FIG. 4(*b*) is a perspective view, of a second variation of the apparatus in FIG. 1, that includes an odd number of planetary rollers in a set, with some parts thereof shown on an enlarged scale;

FIG. 6(*b*) is a front view illustrating the position of the long metal blank relative to one of the planetary rollers and the sun roller;

DETAILS OF THE PREFERRED EMBODIMENTS

First Embodiment

Figure 1:
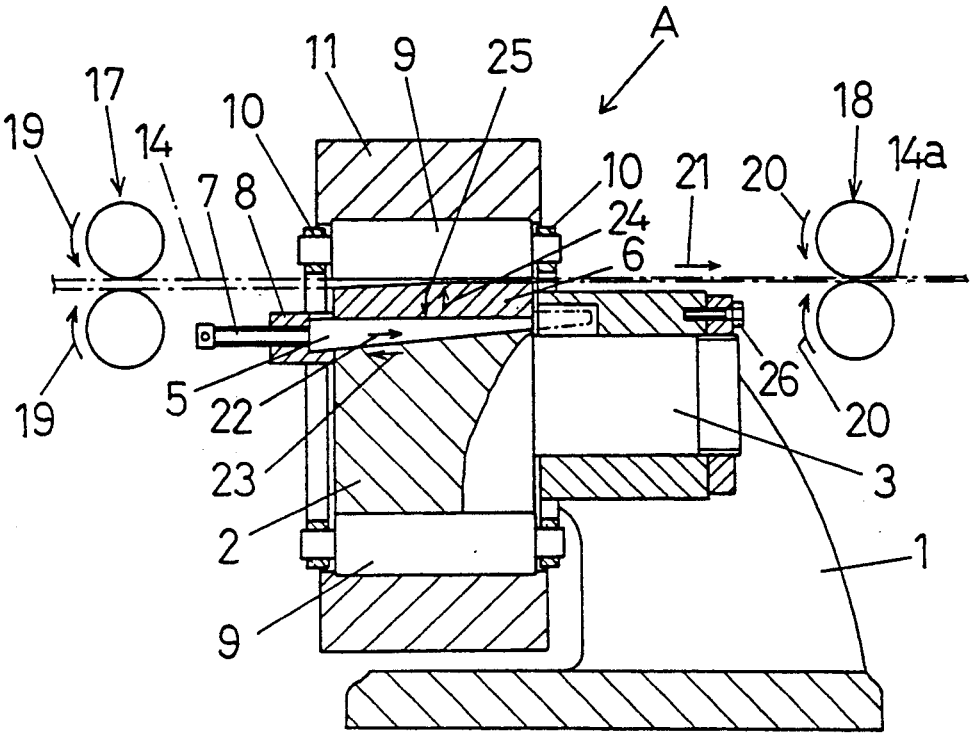
FIG. 1 is a fragmentary sectional view illustrating the apparatus according to a typical preferred embodiment of the present invention that may be used to implement the steps of a method of the invention.
Figure 2:
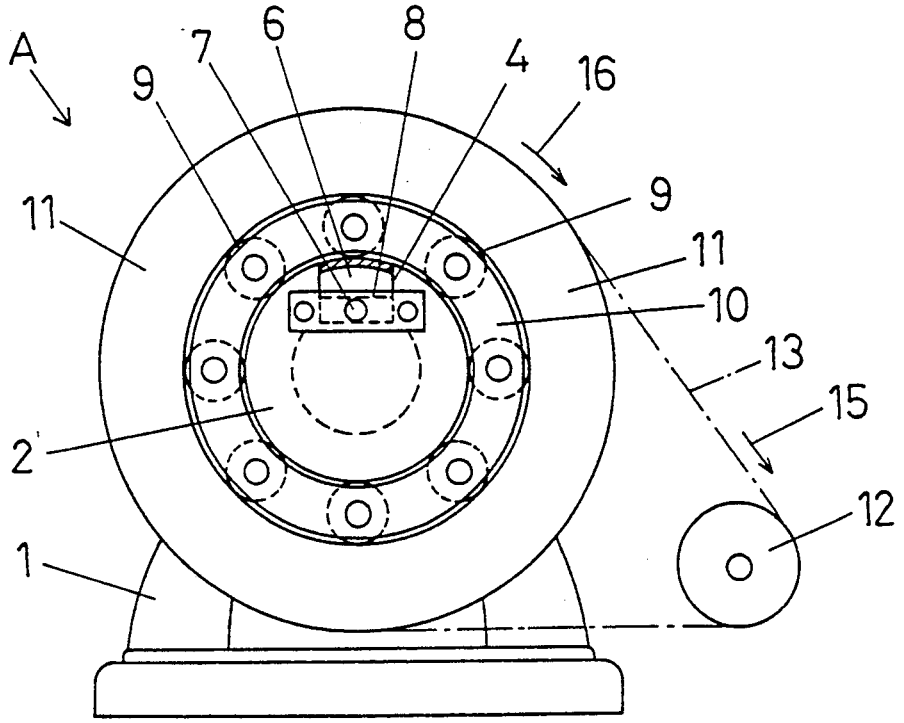
FIG. 2 is a front view of the apparatus of FIG. 1, with some non-essential parts thereof not shown.

A first method according to the present invention is described by referring to FIGS. 1 and 2.

A apparatus that may be used in conjunction with the first method includes a sun roller 2 that has an external diameter of 400 mm, a set of eight (8) planetary rollers 9, 9 rollingly mounted around the sun roller 2 in an equally-spaced relationship, each roller having a diameter of 120 mm and a length of 200 mm (see FIGS. 1 and 2), and a housing 11 mounted around the set of planetary rollers 9, 9 to back them up. In operation, the back-up housing 11 rotates at 500 r.p.m., and then a strip of stainless steel 14 having a thickness of 1 mm and a width of 40 mm is fed between the anvil 6 mounted on the sun roller 2 and the set of planetary rollers 9. After the stainless steel strip 14 has completely passed through one rolling configuration, it has been rolled into a thickness of 0.5 mm and a width of 80 mm. The stainless steel strip may be fed at the rate of 3 m/min., and it has then been observed that it has been elongated by 5% along the length thereof.

The rolling process for individual stainless steel strips can occur in a continuous manner, and the rolling process for each strip can be completed within a very short time. Each individual stainless steel strip through the rolling process can be easily deformed plastically, and its metal structure will exhibit improved mechanical properties. Furthermore, the rolling process can occur in one direction, which can eliminate any possible waves that might otherwise be formed along opposing longitudinal edges. This method can thus yield high-quality products on a mass production basis.

Second Embodiment

Figure 3:
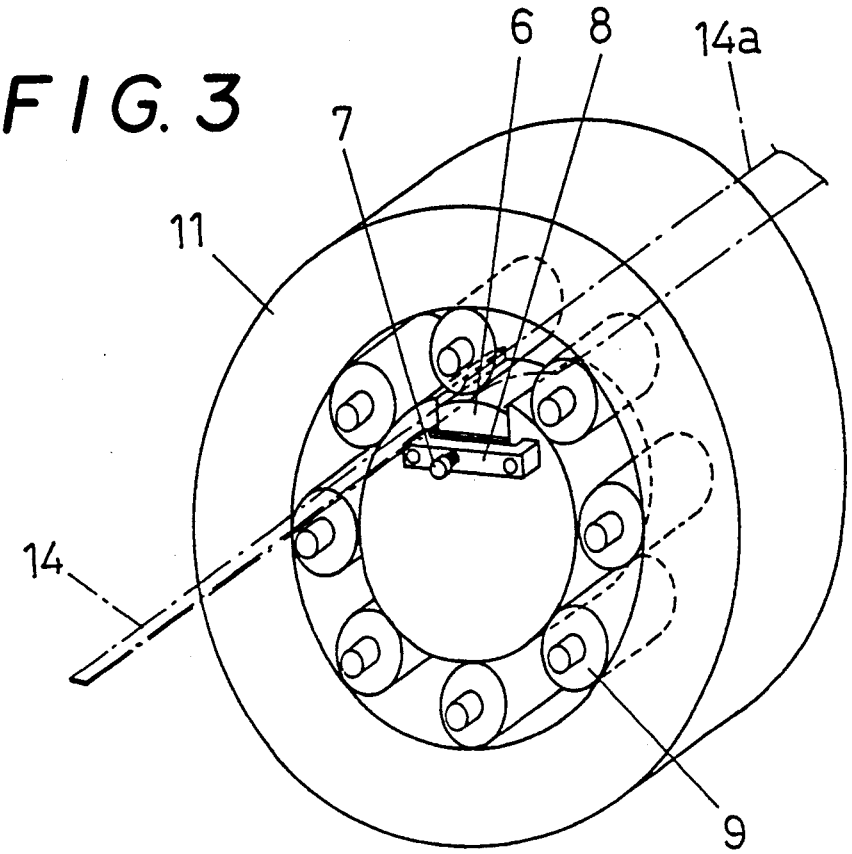
FIG. 3 is a perspective view of the apparatus of FIG. 1, with some essential parts thereof shown on an enlarged scale.

A first apparatus of the present invention is described, and the preferred embodiment of the apparatus is shown in FIGS. 1, 2, and 3. The apparatus, generally designated as "A", includes a machine stand 1 that supports the sun roller 2 mounted to a horizontal shaft 3. The sun roller 2 has a groove 4 formed on the upper side wall thereof and extending in parallel with the center axis through the sun roller 2. The groove 4 can accept a member 5 formed like a wedge and the anvil 6 mounted on the wedge members. An adjusting screw 7 is rigidly connected to the outer end of the wedge-like member (wedge member) 5 so that it can be controlled to move forward or backward. The adjusting screw 7 extends through a support plate 8 fixed to the sun roller 2, and engages the support plate 8 internally so that the adjusting screw 8 can advance or retract through the support plate 8 by being rotated in the appropriate direction. A set of three or more planetary rollers 9, 9 is mounted between annular racks 10, 10 so that the set of planetary rollers 9, 9 can orbit around the outer circumference of the sun roller 2, each individual planetary roller 9 being rotatably supported by its respective shaft in parallel with the shaft 3. A back-up wheel 11 is mounted around the set of planetary rollers 9, 9. The back-up wheel (or housing) 11 is driven by a drive motor (not shown) by means of a belt 13 which threads across the back-up wheel 11 and motor a pulley 12.

Figure 6:
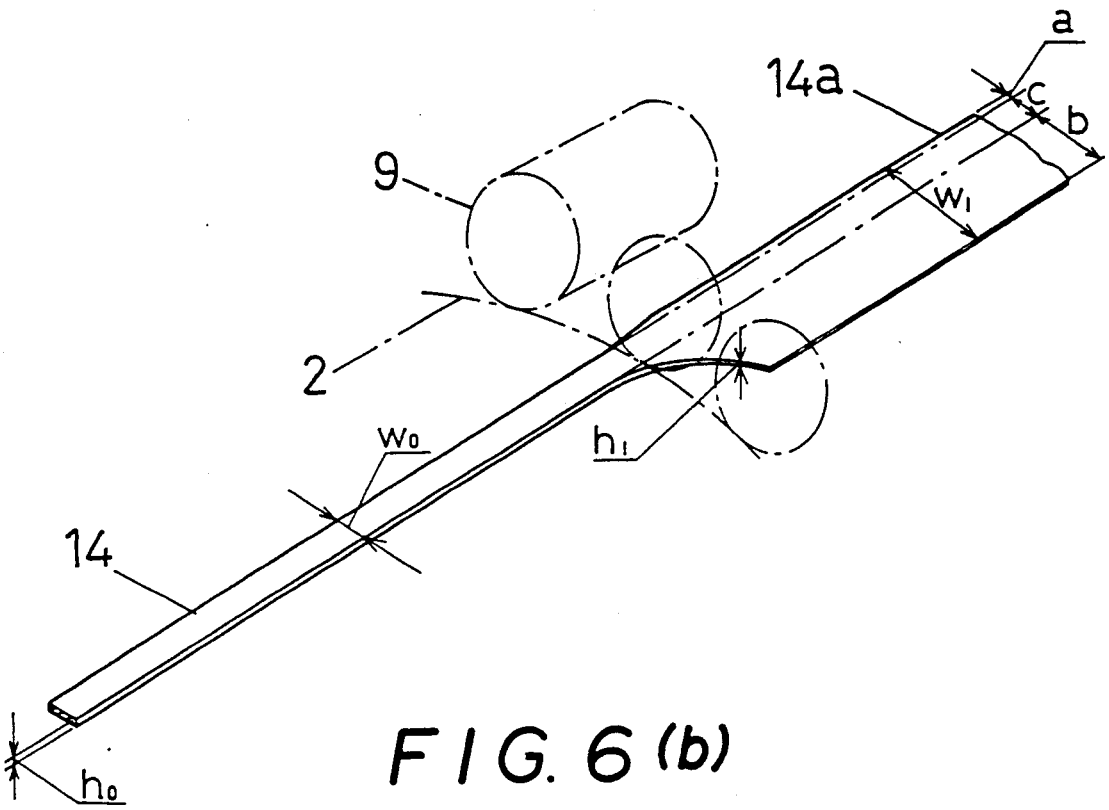
FIG. 6(*a*) is a perspective view of a long metal blank being rolled between a set of planetary rollers and a sun roller.
Figure 6:
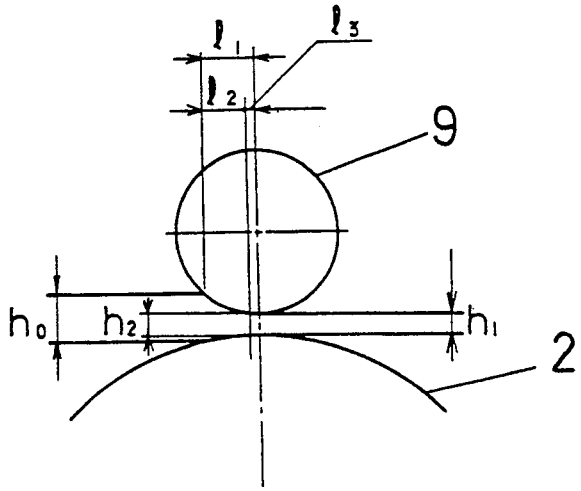

In this embodiment, the motor (not shown) is started up, and a metal blank 14 being rolled, for example, a stainless steel strip, is caused to advance with its front end being guided onto the anvil 6. Then, the belt 13 travels in the direction of an arrow 15, causing the back-up wheel 11 to rotate in the direction of an arrow 16. Thus, the individual planetary rollers can rotate on their respective shafts and orbit around the sun roller 2 in the direction of the arrow 16. That is to say, each of the planetary rollers 9 both rotate about its own axis and orbits about the sun roller 2. The metal blank 14 advances further between the anvil 6 and the set of planetary rollers 9, 9 and is rolled therebetween. When the metal blank 14 has completely passed through the rolling process, it will have been rolled into a product 14*a* whose original width $W_0$ has been elongated to a width $W_1$, as shown in FIG. 6(*a*). The symbols used in FIGS. 6(*a*) and (*b*) have the following meaning:

a = the amount of advance (the amount of elongation of the metal blank in the direction opposite to the rotational direction of the planetary rollers)

b = the amount of retract (the amount of elongation of the metal blank in the rotational direction of the planetary rollers)

$c = W_0$ = the original width of the metal blank before being rolled $h_1$ = the thickness of the metal blank after being rolled $h_0$ = the original thickness of the metal blank before being rolled $l_1$ = the interval between two given working points $l_2$ = the interval between a given working point and a neutral point $l_3$ = the interval between the center line and the neutral point.

After the metal blank has completely passed through the rolling process, its width, $W_1$, may be expressed as follows:

$$W_1 = a + b + c \ (= W_0)$$

Figure 5:
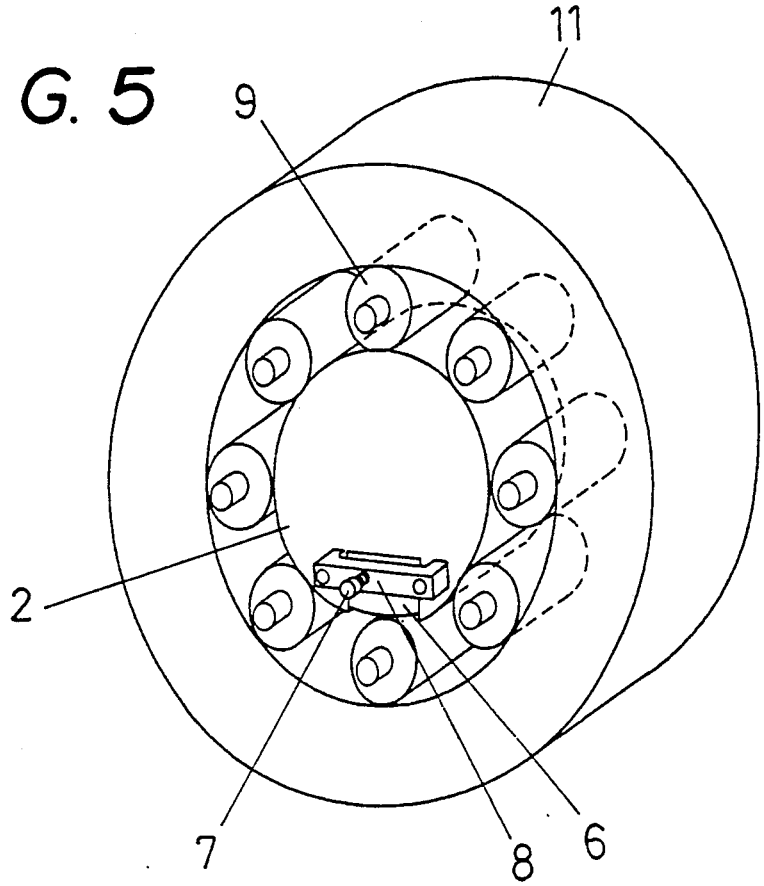
FIG. 5 is a perspective view of an apparatus according to another preferred embodiment of the invention, with some parts thereof shown on an enlarged scale.
Figure 4:
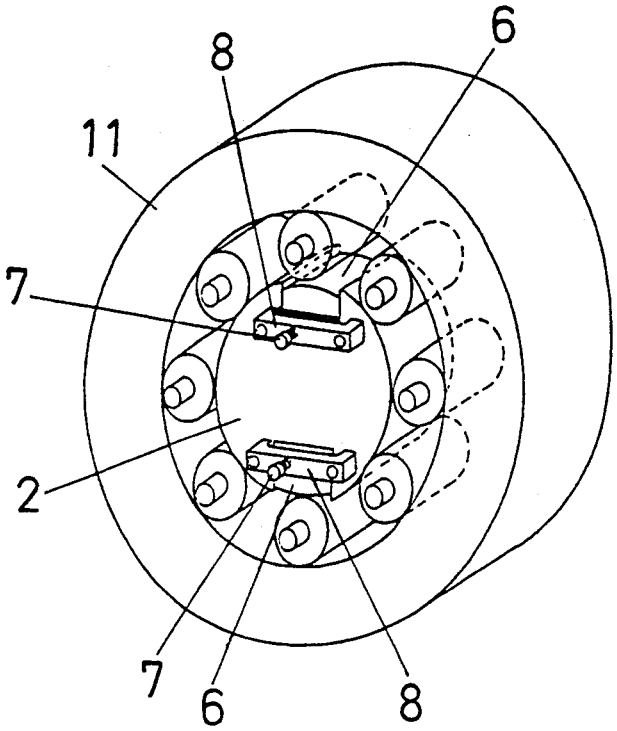
FIG. 4(*a*) is a perspective view of a first variation, of the apparatus in FIG. 1, that includes an even number of planetary rollers in a set, with some essential parts thereof shown on an enlarged scale.
Figure 4:
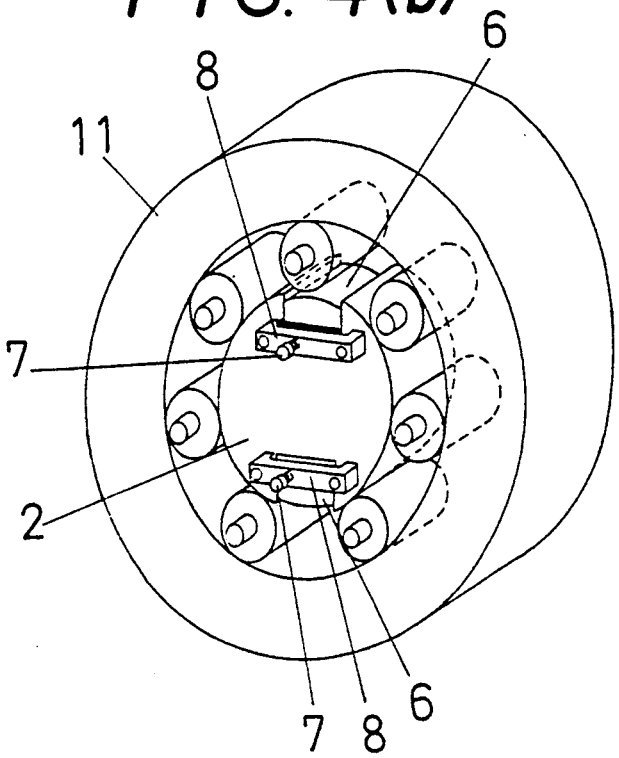

In the embodiment shown in FIGS. 1, 2 and 3, the anvil 6 is mounted above the sun roller 2 with its face being directed upwardly. In the alternative form, the anvil 6 may be mounted with its face being directed downwardly as shown in FIG. 5. In a further variation as shown in FIG. 4, two anvils may be mounted symmetrically with respect to a single sun roller, one with its face being directed upwardly and the other with its face directed downwardly. This arrangement provides double the efficiency. In this case, an even number of planetary rollers (as shown) in FIG. 4(*a*)) may roll the metal blank at two locations at the same time, whereas an odd number of planetary rollers (as shown in FIG. 4(*b*)) may not roll the metal blank at two locations at the same time (because the anvils are provided symmetrically with respect to the single sun roller).

According to the embodiment, two pairs of pinch rollers 17, 18 are provided as shown in FIG. 1, one pair 17 being on the entry side of the machine and the other pair 18 being on the exit side. Those pairs of pinch rollers place the metal blank under an applied tensile stress, under which it can be fed forward. When a particular metal blank 14, such as a stainless steel strip, is being fed into the machine, at which time the metal blank 14 does not engage any one in the planetary roller set, the pairs of pinch rollers 17, 18 are driven for rotation in the direction of respective arrows 19, 20, causing the metal blank 14 to advance in the direction of an arrow 21.

The wedge-like member 5 may be advanced or retracted as indicated by an arrow 22 or 23 by turning the adjusting screw 7 in the appropriate direction. Depending upon the movement of the wedge-like member 5 forward or backward, the anvil 6 may be raised or lowered as indicated by an arrow 24 or 25. In this way, the gap between the upper surface of the anvil 6 and the planetary roller set 9 can be adjusted. This gap may be chosen, depending upon the desired reduction in the thickness of a metal blank being rolled. In FIG. 1, reference numeral 26 refers to a screw that secures the sun roller 2 in position.

Figure 7:
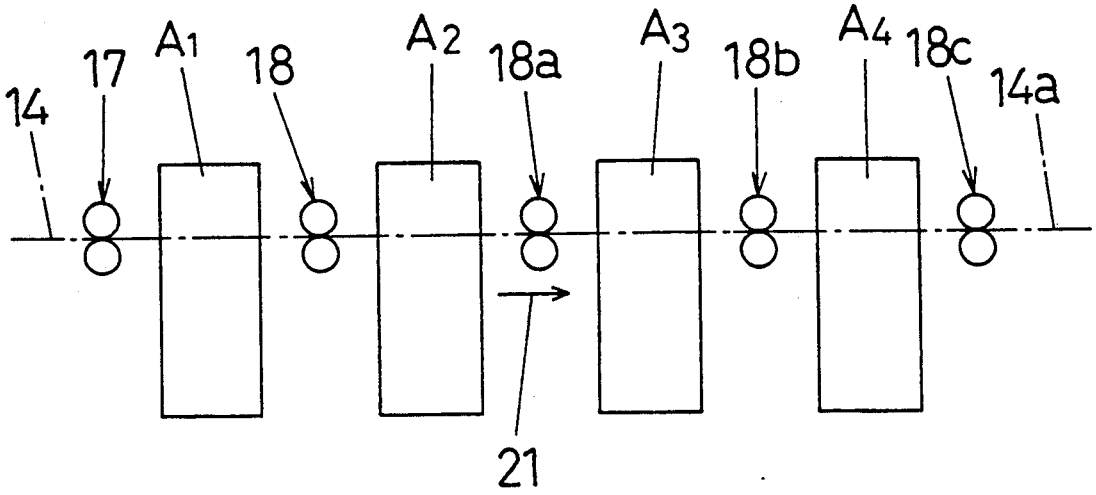
FIG. 7 is a schematic diagram showing a series of rolling units arranged in tandem according to the invention.

The rolling arrangement A as described above may be used as a single unit, namely, as a stand-alone unit, but several rolling units as shown by $A_1$, $A_2$, $A_3$, $A_4$ in FIG. 7 may be arranged in a tandem configuration, such that the rolling units are in series, one being followed by another, followed by another, and so on. In the tandem configuration, a single metal blank may pass through each of the rolling units $A_1$ to $A_4$ until it has been rolled into a final product. For example, a particular metal blank that has the original thickness of 1.0 mm and width of 10 mm may be rolled into the thickness of 0.2 mm and width of 50 mm, respectively.

The number of rolling units that may be included in the tandem configuration may depend upon the particular requirements for a metal blank being rolled.

Figure 8:
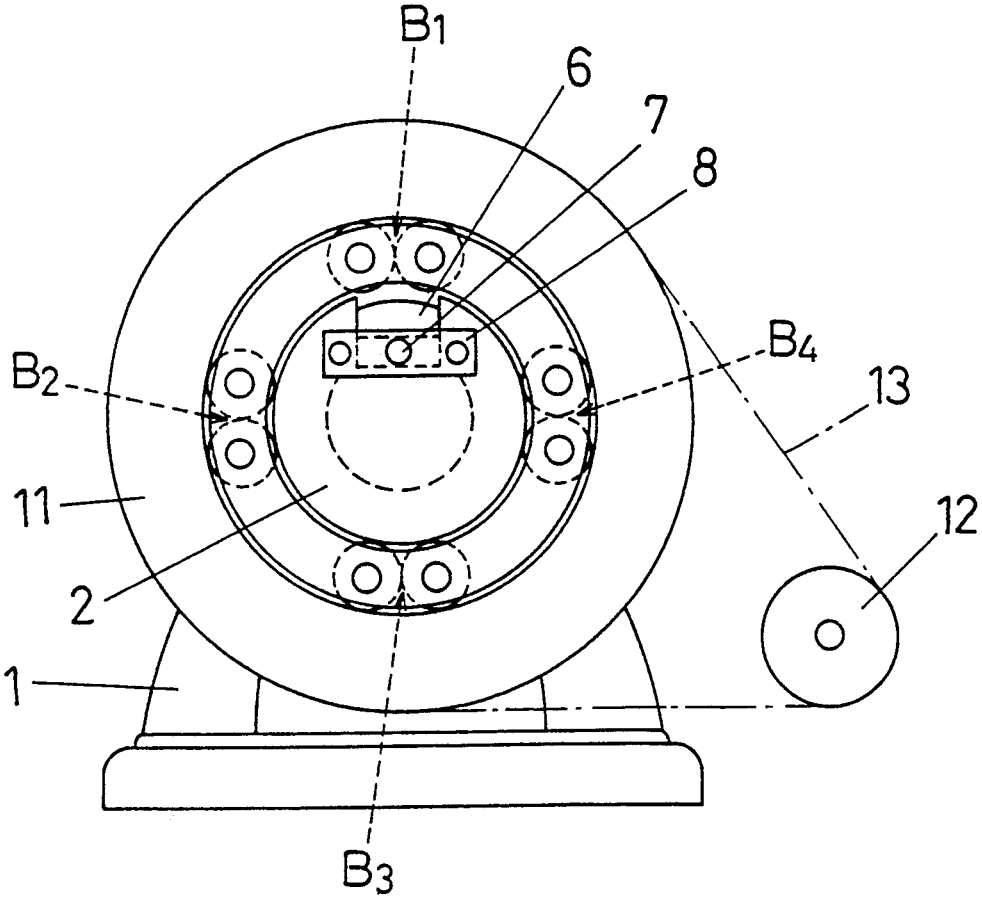
FIG. 8 is a front view of an apparatus according to another embodiment of the invention, with some parts thereof not shown.

If the number of planetary rollers in each individual rolling unit is increased, the interval between the adjacent rollers will be smaller, which can limit the elongation in the width of a metal blank that can be obtained. As shown in FIG. 8, however, this limitation may be removed by providing pairs of adjacent planetary rollers to each other and by providing those pairs $B_1$, $B_2$, $B_3$, $B_4$ at the greatest possible interval.

THIRD EMBODIMENT

Figure 9:
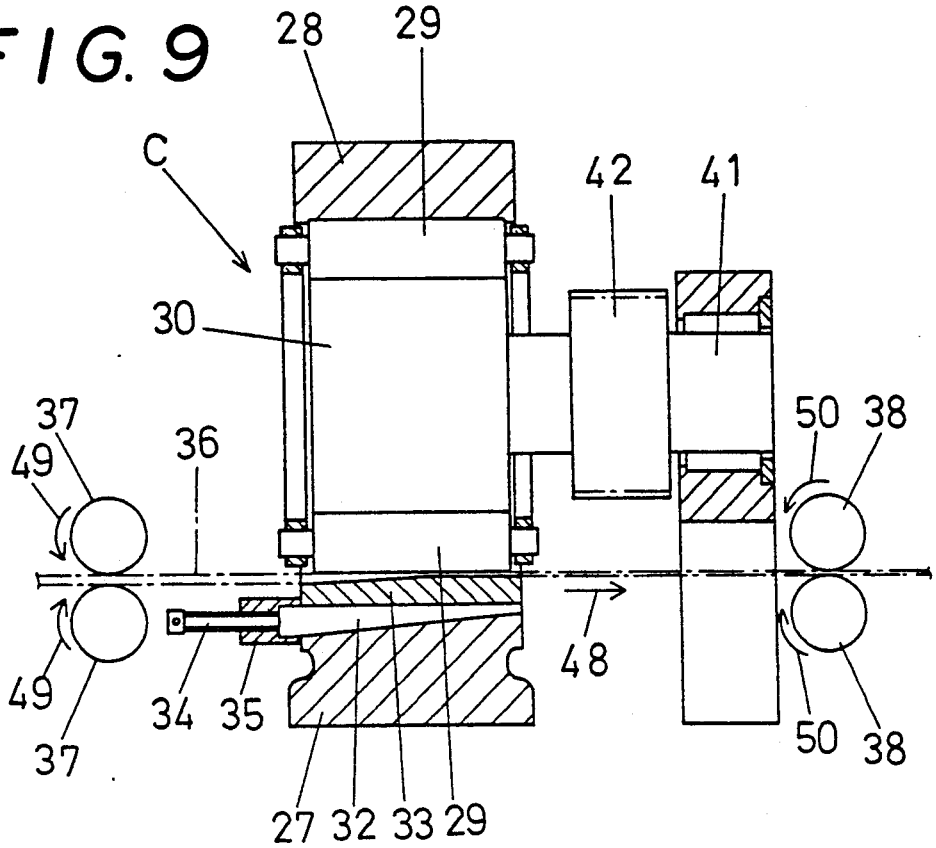
FIG. 9 is a sectional view of an apparatus according to another embodiment of the invention, with some parts thereof not shown, that may be used to implement the steps of the another method of the invention.
Figure 10:
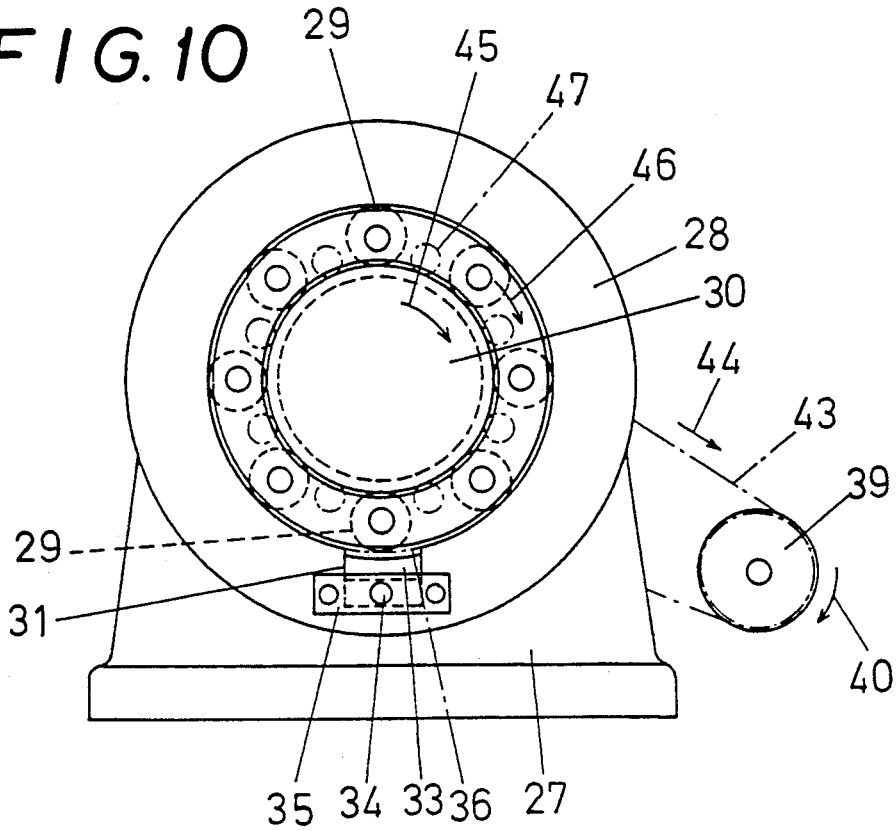
FIG. 10 is a side elevation of the apparatus of FIG. 9.

The second method of the present invention is described by referring to FIGS. 9 and 10.

The apparatus that may be used in conjunction with the second method includes a sun roller 30 of a 400 mm external diameter, a set of eight planetary rollers 29, 29, each having a diameter of 120 mm and a length of 200 mm, rollingly mounted around the sun roller 30 in an equally-spaced relationship, and a back-up housing 28 mounted around the set of planetary rollers 29, 29. In operation, the sun roller 30 may be rotated at 500 r.p.m. A stainless steel strip 36 which has a thickness of 1 mm and width of 40 mm may be fed between an anvil 33 on the inner side of the back-up housing 28 and the planetary roller set 29. This strip blank may be fed at the rate of 3 m/minute, for example, through a given rolling unit as described above, and it may be rolled into a product having a length of 12 m, a thickness of 0.5 mm and a width of 80 mm. In this case, the elongation of the blank along its length is equal to 5%.

As the rolling process through the given rolling unit can occur in a continuous manner within a very short time, the stainless steel strip can easily be deformed plastically and can be provided with improved mechanical properties. Furthermore, the rolling process can occur in one direction, which eliminates any possible waves that might otherwise be formed along opposing longitudinal edges. It may thus be appreciated that the second method provides high-quality products on a mass production basis.

FOURTH EMBODIMENT

The second apparatus of the present invention is described by referring to FIGS. 9 and 10.

The apparatus, generally designated as C, includes a machine stand 27 to which the back-up housing 28 is secured. The back-up housing 28 contains the plurality of planetary rollers 29, 29 that are mounted in the equally-spaced relationship. Inside the set of planetary rollers, the sun roller 30 is mounted. The back-up housing 28 has a groove 31 formed on the inner bottom side, extending longitudinally and axially of the back-up housing. This groove 31 accepts a wedge-like member (wedge member) 32 and an anvil 33 therein mounted on the wedge-like member in that order. An adjusting screw 34 is rigidly connected to the outer end of the wedge-like member 32 so that it can be controlled to move forward or backward. The adjusting screw 34 extends through a support plate 35 fixed to the back-up housing 28, and engages the support plate 35 internally so that the adjusting screw 34 can advance or retract through the support plate 35 by being rotated in the appropriate direction.

Two pairs of pinch rollers 37, 38 are provided, one pair 37 being on the entry side of the apparatus C and the other pair 38 being on the exit side. Those pairs of pinch rollers 37, 38 may store the rotational force required to drive a metal blank to advance in the direction of an arrow 48 in FIG. 9, or may be driven by a pulse motor or any other drive means such as synchro-motor. In the latter case, the pulse motor or synchro-motor may be energized immediately after the rolling process by each one of the planetary rollers 29, 29 is completed, driving the pairs of pinch rollers to rotate in the direction of respective arrows 49, 50 so that the metal blank can travel forward by the required length in the direction of an arrow 48. In this way, the amount of travel can be controlled constantly for every pitch, and the metal blank can thus be rolled uniformly over the total length thereof.

In the embodiment, the anvil 33 is provided on the inner bottom side of the back-up housing 28, but it also may be provided on the inner top side of the back-up housing. In either case, a long metal blank 36 may be placed under tensile stress by the pairs of pinch rollers 37, 38, and the metal blank 36 can always engage the anvil 33 whether it is provided on the bottom or on the top. Therefore, even if the anvil 33 is provided on the top of the back-up housing 28, the metal blank will be prevented from falling under its own weight. Thus, the rolling process can proceed with no difficulty.

According to the embodiment, a drive motor (not shown) is started up, and a timing pulley 39 is rotated in the direction of an arrow 40. A timing belt 43 that is threaded across the timing pulley 39 and a timing pulley 42 secured to a shaft 41 supporting the sun roller 30 then travels in the direction of an arrow 44. This causes the sun roller 30 to rotate in the direction of an arrow 45. As the sun roller 30 is rotated, each planetary roller in the set travels around the sun roller 30 while rotating about its own axis. That is, each planetary roller rolls in the direction of an arrow 46. As each planetary roller rolls, the metal blank advances between the set of planetary rollers 29 and the anvil 33. The reduction in the thickness or elongation across the width can be provided through every step of the rolling process.

Figure 13:
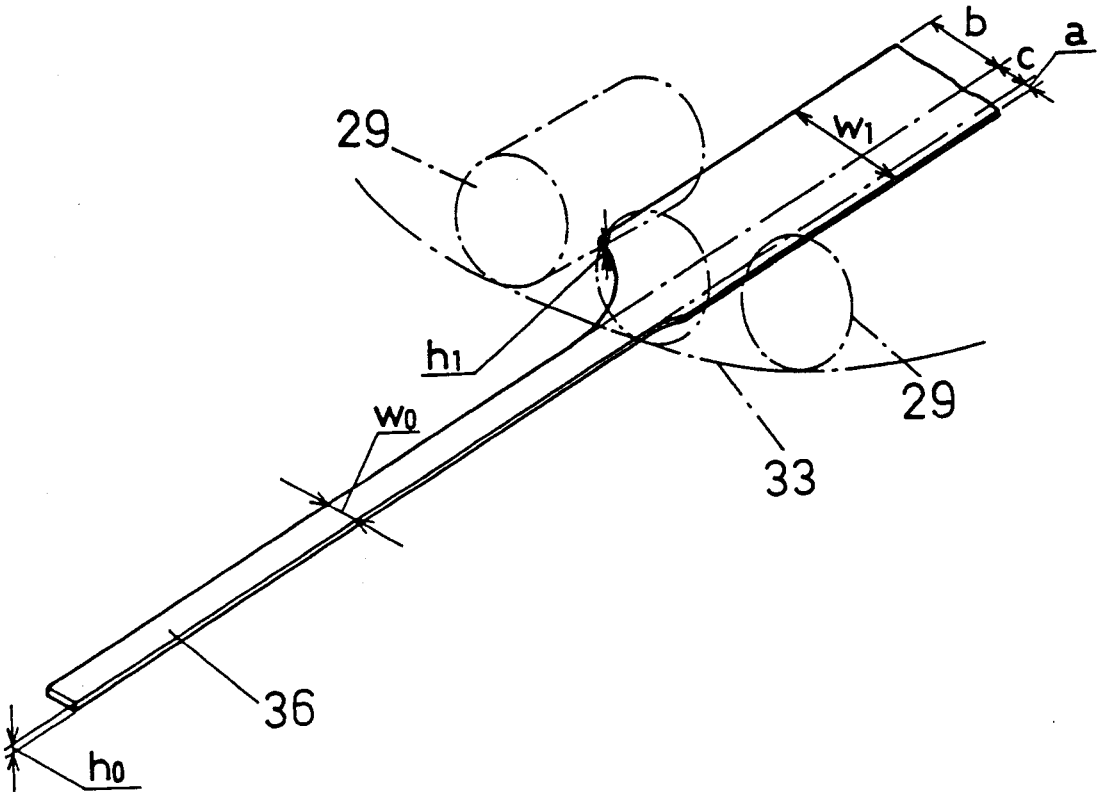
FIG. 13 is a perspective view illustrating a long metal blank being rolled between a set of planetary rollers and a housing.

When a particularly long metal blank has passed through the planetary roller set 29 and anvil 33 in the rolling unit according to this embodiment, its original width $W_0$ and thickness $h_0$ may be elongated to the width $W_1$ and reduced to the thickness $h_1$, respectively, as shown in FIG. 13. In FIG. 13, the symbol "a" refers to the amount of advance, "b" refers to the amount of retract, and "c" is equivalent to the width $W_0$.

Through the rolling process as described above, the product of the long metal blank provides a working hysteresis according to which it is elongated along its length, and also provides a working hysteresis according to which it may be rolled across its width. Thus, those two working hystereses are crossed, and the product thus rolled can be provided with improved mechanical properties.

Preferably, the surface of each pinch roller 38 is curved to match the shape in cross section of the product of the metal blank. This is preferred because a metal blank is rolled into a curved surface having its cross section that is analogous to the outer circumference formed by the individual planetary rollers 29 in orbit.

An intermediate roller 47 may additionally be interposed between each adjacent pair of planetary rollers 29. When these intermediate rollers 47 are provided, they can effectively prevent the metal blank from being sprung during the rolling process.

FIFTH EMBODIMENT

Figure 11:
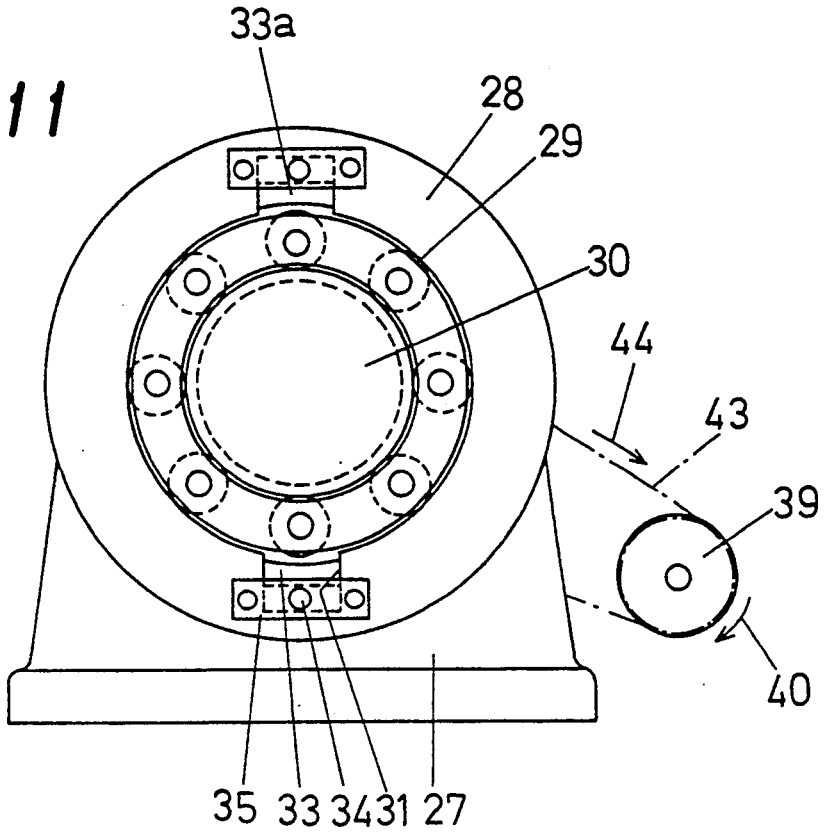
FIG. 11 is a side elevation of a variation of the embodiment shown in FIG. 10.

According to the fifth embodiment shown in FIG. 11, a back-up housing 28 contains an upper anvil 33*a* and a lower anvil 33. When an even number of planetary rollers 29, 29 are provided, the rolling process is performed simultaneously by the two anvils, and when an odd number of planetary rollers 29, 29 are provided, the rolling process is performed alternately by the two anvils. Although the choice between the simultaneous or alternate rolling process may depend upon the particular type of material of the long metal blank to be rolled, the amount of reduction that should be obtained for every step, the rolling speed, the width of the metal blank that should be obtained, and other considerations, the alternate rolling process is often the better ones since there are fewer problems. The rolling process may occur as described in connection with the fourth embodiment, and therefore no further description is provided.

SIXTH EMBODIMENT

Figure 12:
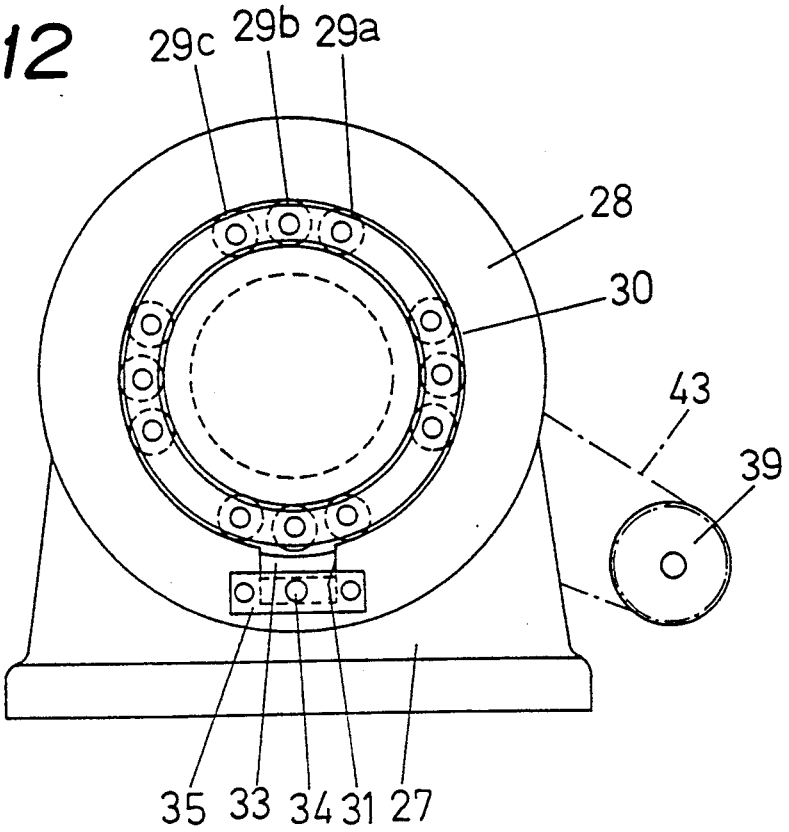
FIG. 12 is a side elevation of another variation of the embodiment of FIG. 10.

The embodiment shown in FIG. 12 includes four sets of three planetary rollers 29*a*, 29*b*, 29*c*, those sets being arranged at positions 90° apart. For example, a sun roller has a diameter of 400 mm and each planetary roller has a diameter of 80 mm. Thus, a total of twelve planetary rollers may be used. When the metal blank has been rolled by the first set of planetary rollers, it is advanced. Despite the larger number of planetary rollers, this embodiment can roll the metal blank into a wider product (the rolled width of 160 mm compared against the original width of 80 mm). According to the embodiment, the metal blank may be advanced between 5 mm and 10 mm for every step.

Once the metal blank engages a given planetary roller 29*a* in a given set, this roller 29*a* starts to roll the metal blank, and then the required reduction may be obtained. In this case, the remaining rollers 29*b* and 29*c* that follows the first roller 29*a* in that set provide the skin pass rolling. In this manner, the final product can have an improved flatness, and can therefore have an improved product quality with no irregularities in thickness.

SEVENTH EMBODIMENT

Figure 14:
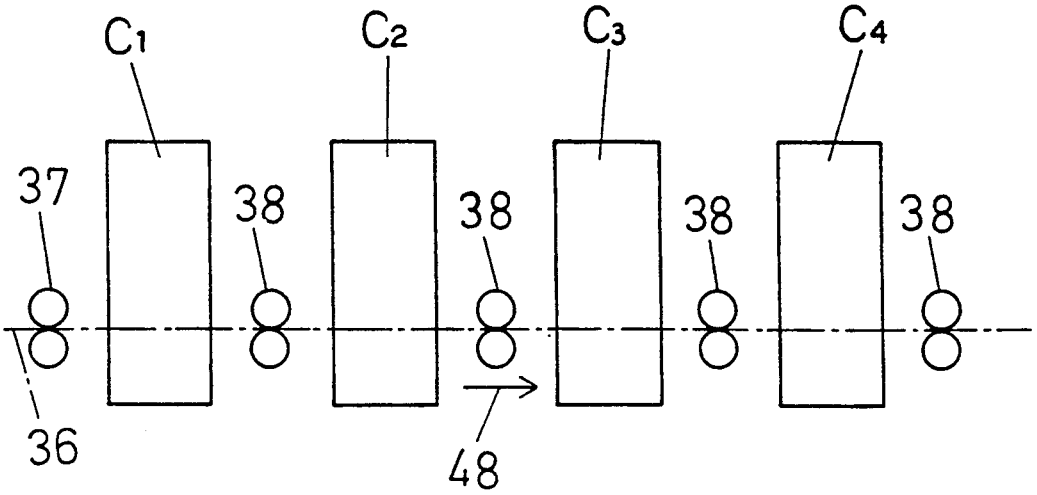
FIG. 14 is a schematic diagram illustrating a series of rolling units arranged in tandem according to another embodiment.

According to the embodiment shown in FIG. 14, several rolling units $C_1$, $C_2$, $C_3$, $C_4$ are arranged in tandem. In the tandem configuration, the amount of reduction that may be obtained through each of the rolling units in series can be smaller, but the total required reduction can be obtained through the tandem arrangement of the rolling units. Thus, the tandem configuration provides a high rolling speed.

When the metal blank passes through each rolling unit, each planetary roller in a set in each rolling unit rolls the metal blank. In this embodiment, the metal blank is advanced a distance equal to the length of each planetary roller every time each planetary roller rolls, so that little or no elongation can occur along the length of the metal blank for each rolling. Thus, the metal blank can be advanced by the same amount at each succeeding rolling unit.

Although the present invention has been fully described with reference to the several preferred embodiments thereof, it should be understood that various changes and modifications may be made without departing from the spirit and scope of the invention as defined in the appended claims.

What is claimed is:

1. A planetary cross-rolling method for rolling a long metal blank across the width thereof, the method comprising:

providing a sun roller and set of planetary rollers, each of said planetary rollers being mounted for rolling around said sun roller; and feeding the long metal blank between said sun roller and said set of planetary rollers in a direction parallel to center axial lines through said sun roller nd said set of planetary rollers, thereby rolling the long metal blank into a required thickness and width.

2. The method as defined in claim 1, wherein said step of feeding the long metal blank between said sun roller and said set of planetary rollers comprises feeding the long metal blank under an applied tensile stress, and then advancing the long metal blank by a predetermined length for each interval between each adjacent pair of rollers, thereby rolling the long metal blank successively as it advances stepwise.

3. The method as defined in claim 1, wherein said step of feeding the long metal blank between said sun roller and said set of planetary rollers comprises feeding the long metal blank by a predetermined length thereof immediately after one planetary roller finishes rolling, and advancing it by said predetermined length thereof at each interval between each adjacent pair of rollers.

4. A planetary cross-rolling apparatus comprising:

a machine stand;

a sun roller mounted to said machine stand and having an outer wall;

an anvil mounted to part of the outer wall of said sun roller;

a set of planetary rollers mounted to roll around said sun roller;

a back-up wheel mounted outside said set of planetary rollers; and feeding means for feeding a long metal blank between said anvil and said set of a plurality of planetary rollers in a direction parallel to a center line aligned with center axial lines through said set of planetary rollers.

5. The apparatus as defined in claim 4, wherein said sun roller includes a groove, formed on part of the outer wall of said sun roller and extending longitudinally in parallel with a center axis of said sun roller, for movably receiving said anvil such that said anvil is movable into and out of said groove; and a wedge-like member is mounted between an inner bottom of said groove and an inner wall of said anvil for controlling movement of said anvil into and out of said groove.

6. The apparatus as defined in claim 5, wherein said anvil includes one anvil mounted on an upper side or a lower side of said sun roller, or two anvils one of which is mounted on the upper side of said sun roller and the other of which is mounted on the lower side of said sun roller.

7. The apparatus as defined in claim 4, wherein said feeding means includes pairs of pinch rollers, one pair being on an entry side of said apparatus and the other pair being on an exit side of said apparatus and the other pair being on an exit side of said apparatus.

8. The apparatus as defined in claim 4, wherein said anvil includes one anvil mounted on an upper side or a lower side of said sun roller, or two anvils one of which is mounted on the upper side of said sun roller and the other of which is mounted on the lower side of said sun roller.

9. The apparatus as defined in claim 4, wherein said set of planetary rollers includes a predetermined number of planetary rollers mounted circumferentially along an inside of said back-up wheel in an equally-spaced relationship.

10. The apparatus as defined in claim 4, wherein said set of planetary rollers includes a predetermined number of planetary rollers mounted circumferentially along an inside of said back-up wheel in an equally-spaced relationship.

11. The apparatus as defined in claim 4, wherein a plurality of units of said apparatus are arranged in a tandem configuration.

* * * * *